United States Patent [19]

Mikkelsen et al.

[11] 4,005,795

[45] Feb. 1, 1977

[54] COLLAPSIBLE CONTAINER

[75] Inventors: Jorgen Mikkelsen, Wynberg, Cape Province; David Rennie Kingsley Groves, Constantia, Cape Province; Peter John Herbert, Bishopscourt, Cape Province, all of South Africa

[73] Assignee: Plastipak (Proprietary) Limited, Cape Town, Cape Province, South Africa

[22] Filed: Oct. 14, 1975

[21] Appl. No.: 622,198

[30] Foreign Application Priority Data

Oct. 18, 1974 South Africa ..... 74/6647

[52] U.S. Cl. ..... 220/7; 220/6; 220/62

[51] Int. Cl.[2] ..... B65D 7/24; B65D 7/42

[58] Field of Search ..... 220/6, 7, 62, 72, 74; 206/503, 508

[56] References Cited

UNITED STATES PATENTS

| | | | |
|---|---|---|---|
| 3,331,529 | 7/1967 | Slapnik | 206/508 |
| 3,349,289 | 10/1967 | Mueller | 220/62 X |
| 3,432,061 | 3/1969 | Anderson | 220/7 |
| 3,655,114 | 4/1972 | Turner | 220/7 X |
| 3,917,102 | 11/1975 | Repetti | 220/7 X |

*Primary Examiner*—William Price
*Assistant Examiner*—Steven M. Pollard
*Attorney, Agent, or Firm*—Ladas, Parry, Von Gehr, Goldsmith & Deschamps

[57] ABSTRACT

A container blank comprises a base panel; wall panels joined to the base panel; and a lid panel joined to one of the wall panels along an edge thereof remote from its junction with the base panel. The junctions between the panels are formed by hinges which are integral with the panels. Interengageable fingers and openings are provided for releasably securing the walls in their erected condition, the fingers being disposed on edge portions of at least some of the wall panels for passing through the openings and hooking over edge portions of the adjacent wall panels.

15 Claims, 6 Drawing Figures

COLLAPSIBLE CONTAINER

This invention relates to containers and particularly, but not exclusively, to containers for receiving products such as soft fruits which are prone to damage by crushing.

According to the invention, a container blank comprises a base panel; wall panels joined to the base panel; and a lid panel joined to one of the wall panels along an edge thereof remote from its junction with the base panel, wherein the junctions between the panels are formed by hinges which are integral with the panels, wherein interengageable fingers and openings are provided for releasably securing the walls in their erected condition, and wherein the fingers are disposed on edge portions of at least some of the wall panels for passing through the openings and hooking over edge portions of the adjacent wall panels.

The blank is preferably provided with stop means for restricting or preventing accidental dislodgement of the fingers from the edge portions. The stop means may be in the form of shoulders located adjacent to each opening, for example on one or each side thereof. When the container is erected and a force is exerted on the panel, the shoulders may engage the panel having the fingers thereon at one or each side of the fingers. Removal of the fingers from the openings may thus be inhibited.

Those edges of the panels having the fingers or openings thereat may be in the form of marginal edge portions and may be such that the adjacent edge portions overlap when the container is erected. The fingers may extend from the free ends of respective edge portions, and the openings may each be provided in the region of the junction between respective edge portions and the remainder of the panel in which the openings are formed.

The edge portions bearing the fingers may each be constructed to permanently extend away from the remainder of the panel of which they form part and out of the plane thereof, as may the other edge portions. The included angle between this plane and the edge portions may advantageously be approximately 45°. The fingers may extend towards the said plane from the said free ends of the respective edge portions. If the hinges are inherently resilient and bias the wall panels away from their erected condition, the resilience of the hinges can then enhance the engagement of the fingers with the edge portions of the adjacent wall panels.

A rib may extend along the edge portions containing or adjacent to the openings. These ribs may partly define sockets into which the associated fingers extend after they have passed through the respective openings. This arrangement can also help to prevent the fingers from being accidentally dislodged from the openings. The ribs may additionally serve to strengthen the respective panels when the container formed from the blank is under load. The base may be provided with raised portions on which the edge portions may rest to further improve the container strength. Furthermore, strengthening ribs may be provided to support flanges in the region of the fingers. These ribs may extend at right angles to the adjacent edges of the respective panel for all or substantially all of the width of the edge portions.

The lid and base panels of the blank may each have regions which are depressed or raised with respect to the remainder thereof and these regions can interengage when erected containers formed from the blank and other similar blanks are stacked one on top of another.

The container blank may be moulded in one piece from synthetic plastic material and may have integral therewith, or be formed to receive, means for releasably securing the lid in its closed condition. Such means may comprise studs and apertures, the apertures serving to receive the studs and each stud being integral with an associated panel. The studs may be U-shaped with retaining ribs extending along opposite sides of the U, and may be a snap-fit in the apertures.

Ventilation holes can be provided in each of the panels, and in particular in the raised or depressed regions to provide communication between the panels.

An embodiment of the invention will not be described, by way of example, with reference to the accompanying drawings, in which.

Figure 1:
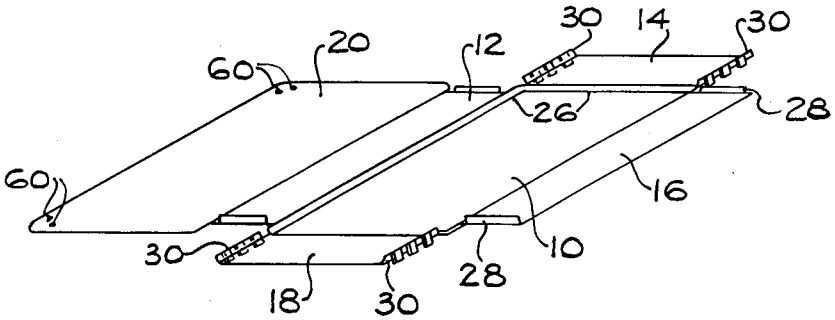
FIG. 1 is a diagrammatic, perspective view of a one-piece injection moulded container blank.
Figure 1A:
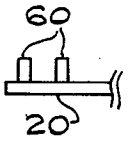

Referring firstly to FIG. 1, the container blank illustrated comprises a base panel 10, four side panels 12 to 18 hingedly connected to the base panel 10, and a lid panel 20 hingedly connected to the side panel 12. The blank is injection-moulded as one piece and the preferred material is polypropylene.

The base panel 10 is formed with ten substantially square areas 22 (FIG. 2) which are displaced from the plane of the remainder of the base panel 10 and which, when viewed from below, form recesses. The areas are position around the margin of the panel 10 and ventilation holes 24 are formed in each area 22. The areas 22 could, if desired, be of another symmetrical shape such as round and can be provided in numbers other than ten.

The number of areas 22 may be changed depending on the size of the box.

Figure 3:
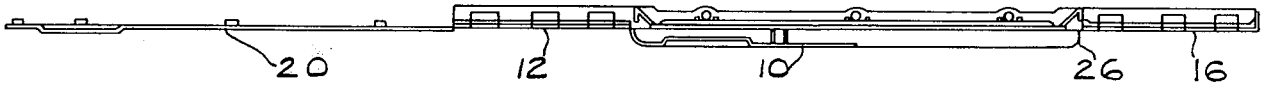
FIG. 3 is a section on the line III–III of FIG. 2.

The edges of the base panel 10 are constituted by upwardly curving portions 26 (FIGS. 1 and 3) with the upper edges of which the panels 12 to 18 are integral. Between each panel 12 to 18 and the related portion 26 is a hinge constituted by a wall zone of reduced thickness.

The panels 12 to 18 are formed with edge portions 28 and 30 (see FIGS. 1 and 2) which lie at angles of approximately 45° with respect to the remainders of these panels. The portions 28 and the panels 12 and 16 are each formed with a row of openings 32 at the junctions therebetween. Fingers 34, which mate with the openings 32 when the container is in the erected condition, are formed on the portions 30 of the panels 14 and 16. The portions 28 are each connected to the remainder of the associated panel 12 and 16 and each lie at an angle of approximately 45° to the associated panel. Each flange portion 30 is connected to the remainder of the associated panel 14 and 18 so that these portions 30 are incapable of very great movement about their line of connection with the remainder of the associated side panel 14 or 18.

Figure 2:
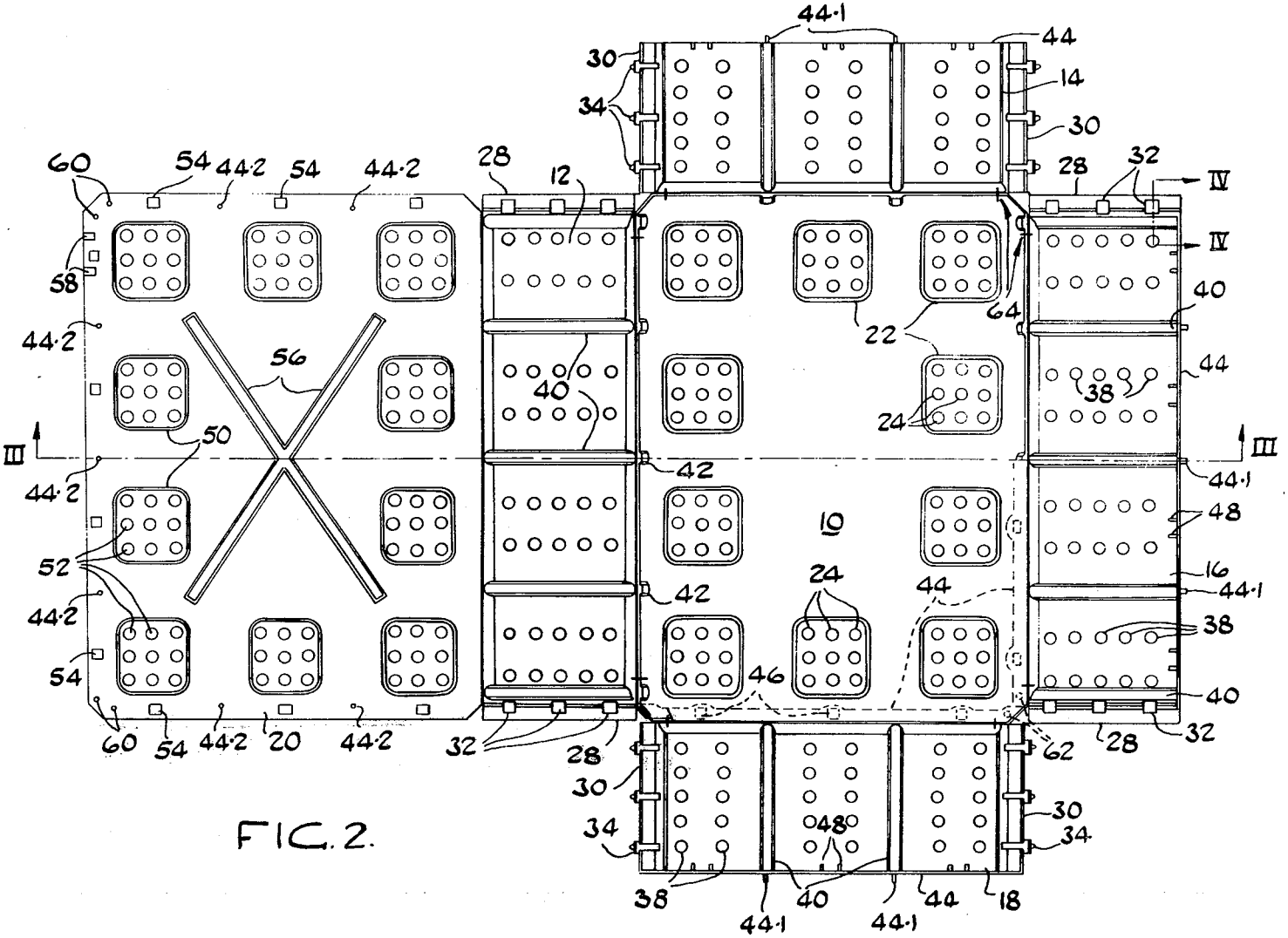
FIG. 2 is a more detailed plan view of the blank of FIG. 1.
Figure 5A:
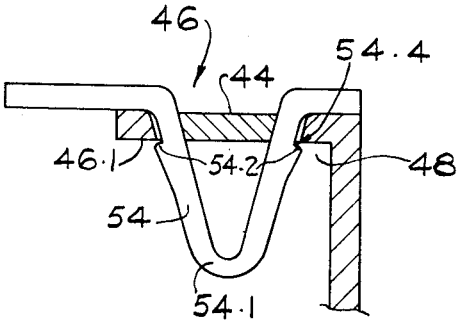
FIGS. 5A and 5B illustrate, to a larger scale, a locking arrangement comprising a stud and hole of one component and an aperture and sealing knob of a further component.
Figure 5B:
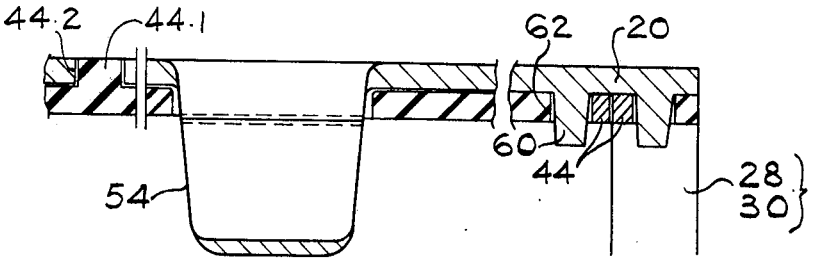

The lid 20 is provided with studs 60 and flanges 44 on walls 14, 16 and 18 are provided with apertures 62 for receiving the studs, see FIGS. 1, and 2 and 5B. These studs and apertures strengthen the corner connection when the box is in an erected condition, which prevents the box from warping when picked up by one corner.

Figure 4:
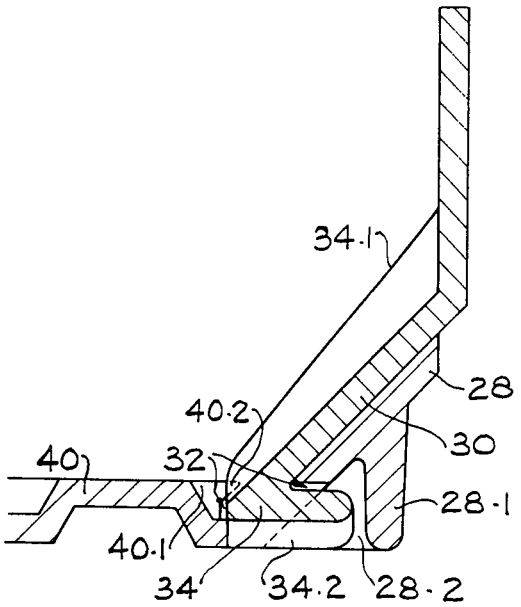
FIG. 4 is a partial section on the line IV–IV in FIG. 2 when the container is in its closed condition.

The panels 12 to 18 are all formed with ventilation holes 38 and strengthening ribs 40, which ribs, in the erected condition are on the inwardly facing surfaces of the wall panels. These ribs act as load-bearing members. The form of each rib 40 can best be seen in FIG. 4. The curving portions 26 of the base panel 10 are themselves formed with ribs 42 which are aligned with the ribs 40 when the panels 12, 14, 16 and 18 have been brought to their erected position. The hinges between the panels 12 to 18 and portions 26 terminate at points 64, adjacent to the endmost load-bearing ribs on each panel, the panels being detached from the portions 26 outside of the points 64 to allow portions 28 and 34 to flex.

At what are, in the erected condition of the container, the upper edges of the wall panels 14 to 18, there are inwardly projecting flanges 44. These are best seen in the righthand and lower parts of FIG. 2 where the position adopted by the panels 14 and 16 when upright, is shown in dotted lines. Apertures 46 are formed in the flanges 44 and pairs of stacking ribs 48 are formed in the angle between each flange 44 and the associated panel 14, 16 and 18.

The lid panel 20 is also formed with ten areas 50 which are displaced from the plane of the remainder of the lid and which, when viewed from above when the lid is closed, constitute projections. Ventilation holes 52 are formed in the areas. The number of areas 50 may vary with box size.

Studs 54 (which will be described in more detail hereinafter) are provided around the periphery of the panel 20, these studs, when the container is erected and closed, entering the apertures 46 formed in the flanges 44.

The panel 20 is formed with a strengthening, cross-shaped formation 56 in its central area, the formation 56 being depressed in form when the lid panel is closed and viewed from above.

A pair of slots 58, which are of part-circular section when viewed in elevation, may be formed in the lid panel 20 to receive a container opening tool. When the lid is closed, the provision of these slots in what is then the underneath surface of the panel 20 results in two part-circular gaps between the panel 20 and the flange 44 of the panel 16 for receiving the tool.

The openings 32 (FIG. 4) are substantially rectangular and, when the container is formed, fingers 34 pass through the openings. The fingers extend from the edge portions 30 at substantially 45° thereto, and hook over the edge portions 28. The width of each finger is only slightly less than that of the opening. That part of the edge portion 30 adjacent to each finger is reinforced by a rib 34.1 and each finger is reinforced by a rib 34.2. Shoulders 40.1 are provided on the rib 40 at opposite sides of each opening. The shoulders have overhanging portions 40.2. When a force on edge portion 28 is exerted on the panel bearing the finger 34, those parts of the edge portions 30 on either side of the panel are pressed against the shoulder and accidental disengagement of the fingers from the openings 32 is thus prevented. The studs 60 and apertures 62 also help to prevent accidental disengagement.

A rib 28.1 (FIG. 4) extends along each edge portion 28, and, with the edge portion 28, defines a socket 28.2 into which the free ends of the fingers 34 project. This can help to prevent the fingers from being dislodged from the openings 32, as well as increasing container strength. The base may be provided with raised portions on which the edge portions can rest when the container is under load to further strengthen the container.

Turning now to FIGS. 5A and 5B, these figures illustrate one of the studs 54 and one of the apertures 46 with which it co-operates. It will be noted that the aperture 46 is flared at 46.1 so as to facilitate reception of the stud 54 which is rounded at 54.1. Further it will be noted that the flange 44 round the aperture 46 has been strengthened, preventing the side walls from bending when one is erecting the box. The stud 54 is U-shaped and has ribs 54.2 which extend along opposite sides of the stud. The ribs 54.2 form an under-cut at 54.4, enabling the stud to be a snap-fit in the aperture.

The flanges 44 are also provided with sealing knobs 44.1, and complementary holes 44.2 are provided on the lid. The knobs are a firm press-fit in the holes to improve the sealing of the lid. The knobs are advantageously of a length such that they do not project through the lid and interfere with the stacking of the containers.

To erect the container, the panels 14 and 18 are displaced to their upright positions about their hinge connections with the base panel 10, and then the panels 12 and 16 are stood up so that the fingers 34 enter the apertures 32 thus securing the four wall panels in position. It will be understood that the fingers project into the socket 28.2 so that the locking structure at the corners is less visible from outside the container.

After the container is filled, the lid is swung to its closed position and pressed down so that the studs 54 and 60 and knobs 44.1 enter the apertures 46 and 62 and holes 44.2 respectively, to close and seal the lid.

It will be noted that once the container is erected each ventilation hole has a mating one directly opposite thereto in the opposed wall. Each hole can, of course, be of any shape and is of a size such as not to impair the structural strength of the container.

The distribution of the areas 22 and 50 is such that projecting areas 50 enter recesses formed by the areas 22 when the containers are stacked (see FIG. 2) regardless of whether the containers in the two layers extend in the same direction or at right angles to one another.

It will be noted that, when the containers are stacked, the airflow through the stack is not impaired for the ventilation holes in each container register with ventilation holes in the adjacent containers.

We claim:

1. A container blank comprising a base panel; wall panels joined to the base panel and each having marginal edge portions at an angle to the remainder of the respective panel for overlapping edge portions of adjacent wall panels, adjacent edge portions having free ends which point in opposite directions when the blank is erected to form a container; and a lid panel joined to one of the wall panels along an edge thereof remote from its junction with the base panel, wherein the junctions between the panels are formed by hinges which are integral with the panels, wherein interengageable fingers and openings are provided for releasably securing the walls in their erected condition, and wherein the fingers are disposed on and integral with the edge portions of at least some of the wall panels for freely passing through the openings and hooking over the edge portions of the adjacent wall panels.

2. A container blank according to claim 1, including stop means located adjacent to the openings to engage the free ends of the edge portions having the fingers thereon in the region of the fingers, the hinges being inherently resilient and biasing the panels away from the erected condition of the container to enhance the engagement of the fingers with the openings in the adjacent panels.

3. A container blank according to claim 1, wherein the fingers extend from the free ends of the edge portions by which they are carried, and the openings are provided at the junctions between the marginal edge portions and the remainders of the panels in which the openings are formed.

4. A container blank according to claim 1, wherein the fingers carried by each panel are at an angle of about 45° to the edge portion of the panel and the edge portions are at an included angle of about 135° to the remainder of the panel, the fingers being substantially at right angles to said remainder of the panel.

5. A container according to claim 1, wherein ribs extend along those edge portions adjacent to the openings to define sockets for receiving the associated fingers when they pass through the openings.

6. A container blank according to claim 1, wherein the lid and base panels of the blank have complementary depressed and raised regions to interengage with erected containers formed from similar blanks.

7. A container blank according to claim 1, moulded in one piece from synthetic plastic material and including means for releasably securing the lid in its closed condition, such means comprising studs and apertures, the apertures serving to receive the studs and the studs being integral with the associated panel.

8. A container comprising a base panel, wall panels joined to the base panel and having edge portions which overlap one another, the overlapping edge portions having free ends which point in opposite directions, a lid panel joined to one of the wall panels along an edge thereof remote from its junction with the base panel, hinges integral with the panels and forming junctions between the panels, interengageable fingers and openings releasably securing the walls in their erected condition, the fingers passing through the openings and hooking over the edge portions of the adjacent wall panels to retain the box in its erected condition, complementary depressed and raised regions provided by the lid and base panels for engaging such regions of similar containers stacked therewith, and vents in the depressed and raised regions for providing communication between the container and similar containers stacked therewith.

9. A container according to claim 8, including stops for inhibiting accidental dislodgement of the fingers from the edge portions, the stops being shoulders located adjacent to each opening, on at least one side thereof.

10. A container according to claim 8, wherein the fingers extend from the free ends of edge portions of the panels and the openings are provided in the region of the junction between those edge portions of the panel and the remainder of the panel in which the openings are formed.

11. A container according to claim 10, wherein the edge portions bearing the fingers are at an included angle of about 135° to the planes of the remainders of the panels in which they are formed and the fingers on such edge portions extend towards the said planes from the free ends of the respective edge portions.

12. A container according to claim 8, wherein flanges are provided on the wall panels not hinged to the lid panel and lie adjacent to the lid panel, and wherein releasably interengaging studs and apertures are provided on the lid panel and flanges for holding the lid panel against the flanges.

13. A container according to claim 12, wherein the studs are U-shaped portions of the lid panel and have ribs thereon to provide a snap-fit in the apertures.

14. A container blank comprising a base panel; wall panels joined to the base panel; and a lid panel joined to one of the wall panels along an edge thereof remote from its junction with the base panel, wherein the junctions between the panels are formed by hinges which are integral with the panels, wherein interengageable fingers and openings are provided for releasably securing the walls in their erected condition, wherein the fingers are disposed on edge portions of at least some of the wall panels for passing through the openings and hooking over edge portions of the adjacent wall panels, and wherein the fingers carried by each panel are at an angle of about 45° to the edge portions of the panel and the edge portions are at an included angle of about 135° to the remainder of the panel, the fingers being substantially at right angles to said remainder of the panel.

15. A container comprising a base panel, wall panels joined to the base panel, a lid panel joined to one of the wall panels along an edge thereof remote from its junction with the base panel, hinges integral with the panels and forming junctions between the panels, interengageable fingers and openings releasably securing the walls in their erected condition, the fingers passing through the openings and hooking over edge portions of the adjacent wall panels to retain the box in its erected condition, complementary depressed and raised regions provided by the lid and base panels for engaging such regions of similar containers stacked therewith, vents in the depressed and raised regions for providing communication between the container and similar containers stacked therewith, flanges provided on the wall panels not hinged to the lid panel and lying adjacent to the lid panel, and releasably interengaging studs and apertures provided on the lid panel and flanges for holding the lid panel against the flanges, and the studs being U-shaped portions of the lid panel and having ribs thereon to provide a snap-fit in the apertures.

* * * * *

UNITED STATES PATENT AND TRADEMARK OFFICE

CERTIFICATE OF CORRECTION

PATENT NO. : 4,005,795

DATED : February 1, 1977

INVENTOR(S) : Jorgen Mikkelsen et al

It is certified that error appears in the above-identified patent and that said Letters Patent are hereby corrected as shown below:

At column 2, line 16, "not" should read-- now--.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*